US006168147B1

(12) United States Patent
Nose et al.

(10) Patent No.: US 6,168,147 B1
(45) Date of Patent: Jan. 2, 2001

(54) TRANSMISSION MECHANISM FOR PICK-UP ROLLER

(75) Inventors: Yoshitaka Nose; Daisuke Shige, both of Kyoto (JP)

(73) Assignee: Murata Kikai Kabushiki Kaisha, Kyoto (JP)

( * ) Notice: Under 35 U.S.C. 154(b), the term of this patent shall be extended for 0 days.

(21) Appl. No.: 09/139,251

(22) Filed: Aug. 25, 1998

(30) Foreign Application Priority Data

Dec. 27, 1996 (JP) ..... 8-349416
Dec. 27, 1996 (JP) ..... 8-350598
Sep. 8, 1997 (JP) ..... 9-242649

(51) Int. Cl.[7] ..... B65H 5/00

(52) U.S. Cl. ..... 271/10.13; 271/114; 271/116; 271/118

(58) Field of Search ..... 271/118, 117, 271/116, 114, 10.09, 10.11, 10.13

(56) References Cited

U.S. PATENT DOCUMENTS 4,709,911 * 12/1987 Saiki et al. ..... 271/10
5,021,837 6/1991 Uto et al. .
5,116,038 * 5/1992 Kim ..... 271/10
5,203,553 * 4/1993 Chiang et al. ..... 271/10
5,265,857 * 11/1993 Chiang ..... 271/10
5,435,539 * 7/1995 Namiki ..... 271/114
5,462,267 * 10/1995 Hori ..... 271/10.04
5,513,839 5/1996 Green .
5,624,109 * 4/1997 Tanaka ..... 271/10.13
5,671,071 * 9/1997 Ahn ..... 358/498
5,882,002 * 3/1999 Kamei et al. ..... 271/118
6,024,356 * 2/2000 Tanaka et al. ..... 271/10.13
6,042,099 * 3/2000 Takagishi ..... 271/2

FOREIGN PATENT DOCUMENTS 0 346 851 12/1989 (EP) .
2-117531 * 5/1990 (JP) ..... 271/117

* cited by examiner

*Primary Examiner*—Donald P. Walsh
*Assistant Examiner*—David A. Jones
(74) *Attorney, Agent, or Firm*—Hogan & Hartson, LLP

(57) ABSTRACT

A drive power transmission mechanism situated between a drive motor and a pick-up roller for transmitting a drive power to the pick-up roller from the drive motor to rotate the pick-up roller under a normal condition. The rotating pick-up roller picks up a sheet at a time from a stack of sheets piled up on a paper feed tray. The transmission mechanism includes a torque limiter that interrupts drive power transmission to the pick-up roller from the drive motor when the pick-up roller contacts an empty paper tray. The drive power transmission mechanism also includes a clutch for preventing drive power transmission from the pick-up roller to the drive motor. The drive power transmission from the pick-up roller to the drive motor occurs, for example, when both the pick-up roller and a feed roller contact the same sheet and the pick-up roller rotates faster than a predetermined speed.

18 Claims, 6 Drawing Sheets

TRANSMISSION MECHANISM FOR PICK-UP ROLLER

BACKGROUND OF THE INVENTION

1. Field of the Invention

The present invention relates to a transmission mechanism for a pick-up roller, which is provided between a drive power source (e.g., drive motor) and the pick-up roller. The pick-up roller separates a sheet at a time from the top of a stack of sheets. The transmission mechanism may be used in a paper feed unit for a scanner. The paper feed unit feeds an original document or a recording sheet to a scanning area of the scanner. More broadly, the transmission mechanism of the invention may be used in a copier, a facsimile machine, a copier-facsimile hybrid machine, or a printer.

2. Description of the Related Art

Generally, a sheet feeding unit includes a pick-up roller for separating a sheet at a time from the top of a stack of sheets placed on a paper feed tray, a separate roller for transferring the sheet downstream in a sheet passage from the pick-up roller, and feed rollers for accepting the slightly accelerated sheet in an overfeed manner and conveying it to a discharge tray. Such a sheet feeding unit is disclosed in, for example, U.S. Pat. No. 5,624,109. A drive power is transmitted to the separate roller from a drive motor and then transmitted to the pick-up roller. A transmission mechanism for the pick-up roller includes a gear train to connect the pick-up roller with the separate roller such that these rollers rotate synchronously.

However, when all the sheets are taken up from the paper feed tray, the conventional transmission mechanism operates in an overload condition. Specifically, the pick-up roller rotates pressing a stationary surface such as a bottom of the empty paper feed tray. This may damage the gear train of the transmission mechanism. Further, when the sheet reaches the first feed roller but the tail of the sheet is still in contact with the pick-up roller, the transmission mechanism also operates in an overload condition. Specifically, the pick-up roller is forced to rotate (faster than a speed in a normal condition) by the sheet(s) in the overfeed condition. This may also cause various problems.

SUMMARY OF THE INVENTION

One object of the present invention is to provide a transmission mechanism for a pick-up roller that can overcome the above mentioned drawbacks of the conventional transmission mechanism.

Specifically, the present invention intends to provide a transmission mechanism for a pick-up roller that causes no troubles even if the pick-up roller contacts a fixed surface such as the bottom of the empty paper tray and even if the pick-up roller keeps contacting the sheet in the overfeed condition.

According to one aspect of the present invention, there is provided a transmission mechanism for a pick-up roller, comprising a torque limiter located between a drive power source and the pick-up roller for transmitting a drive power to the pick-up roller from the drive power source to rotate the pick-up roller under a normal condition but interrupting drive power transmission to the pick-up roller from the drive power source under a certain operating condition, and a clutch for preventing drive power transmission from the pick-up roller to the drive power source. The drive power transmission from the pick-up roller to the drive power source occurs, for example, in a sheet overfeeding condition.

When the pick-up roller contacts the stationary surface such as the empty paper tray, the torque limiter interrupts transmission of the drive power from the drive power source to the pick-up roller. Therefore, an excessively large load is not exerted on the transmission mechanism. Likewise, when the pick-up roller keeps contacting the sheet in the over-feed condition, the clutch interrupts transmission of the drive power to the drive power source from the pick-up roller. Therefore, the pick-up roller rotates freely (lost motion) so that an excessively large load does not act on the transmission mechanism and a large back tension does not act on the sheet in the over-feed condition.

In order to simplify the structure of the torque limiter, the torque limiter may include a coil spring wound around the pick-up roller. A relatively small unwinding force may be applied to the coil spring when a normal load acts on the pick-up roller, such that the coil spring is still able to transmit the drive power to the pick-up roller. T he relatively small unwinding force does not cause the coil spring to release the pick-up roller so that the drive power is transmitted to the pick-up roller in a normal condition. The pick-up roller rotates upon drive power transmission from the drive power source. When an over load acts o n the pick-up roller, on the other hand, a relatively large unwinding force may be applied to the coil spring so that the coil spring maybe substantially unwound and slip relative to the pick-up roller. For example, when the pick-up roller contacts a stationary surface such as the empty paper tray (overload condition), the coil spring is brought into a loose condition so that there is caused a slip between the coil spring and the pick-up roller. Accordingly, the drive power is not transmitted to the pick-up roller (lost motion of the drive power source). Since the torque limiter is a coil spring, operation of the torque limiter is simple and maintenance is easy.

The transmission mechanism for the pick-up roller according to the present invention is applicable to a document separate and feed device. For instance, the transmission mechanism of the invention may be used in a document feed unit of an image processing apparatus. The image processing apparatus may include both a function of copier and a function of facsimile. It is possible to eliminate troubles caused when there is no sheet in the document feed unit and when a sheet overfeeding condition occurs.

DETAILED DESCRIPTION OF THE INVENTION

Now, a first embodiment of a transmission mechanism for a pick-up roller according to the present invention will be described in reference to FIGS. 1 to 5.

Figure 1:
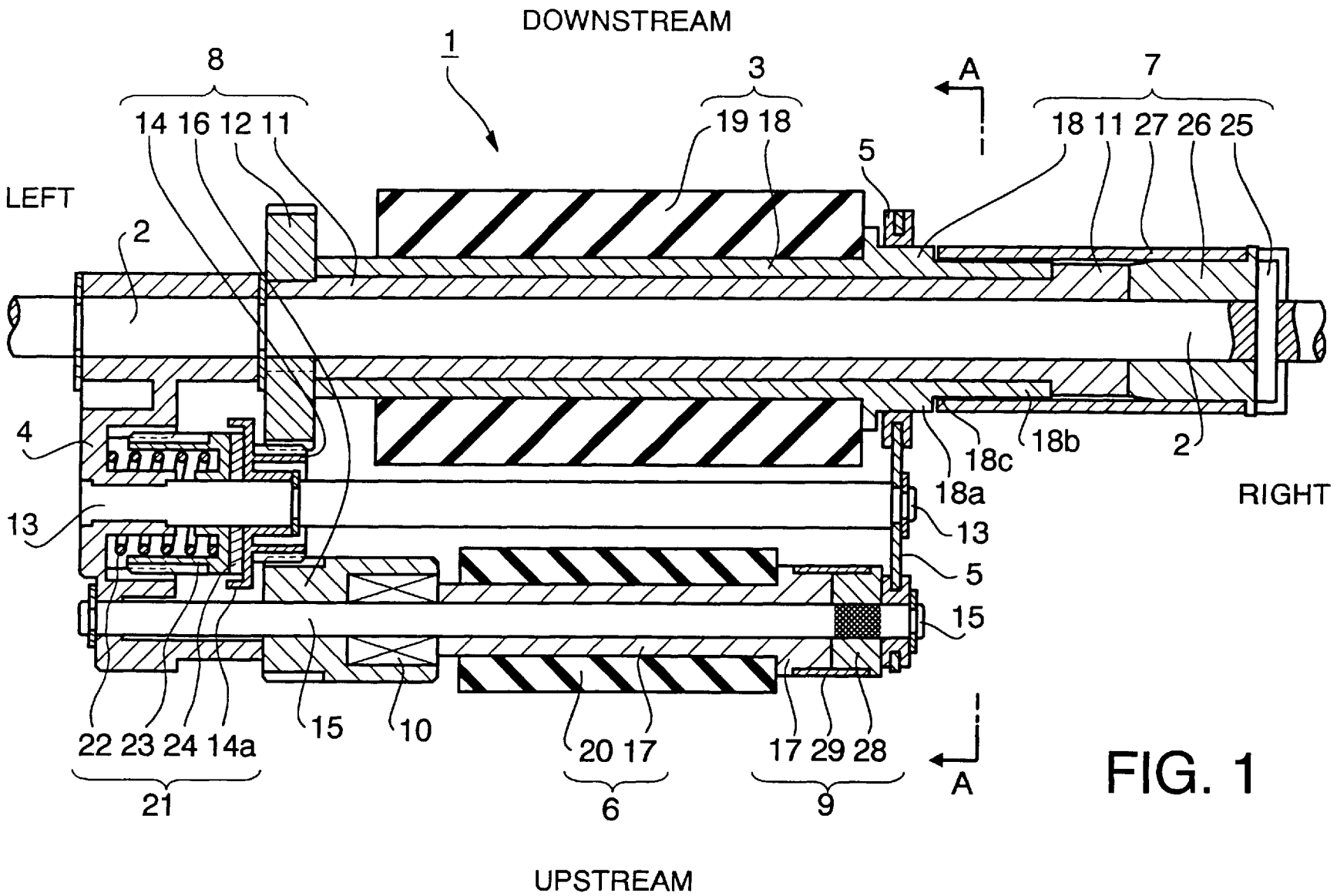
FIG. 1 is a plan cross sectional view of a sheet feeding roller device, into which a transmission mechanism of the present invention is incorporated.
Figure 2:
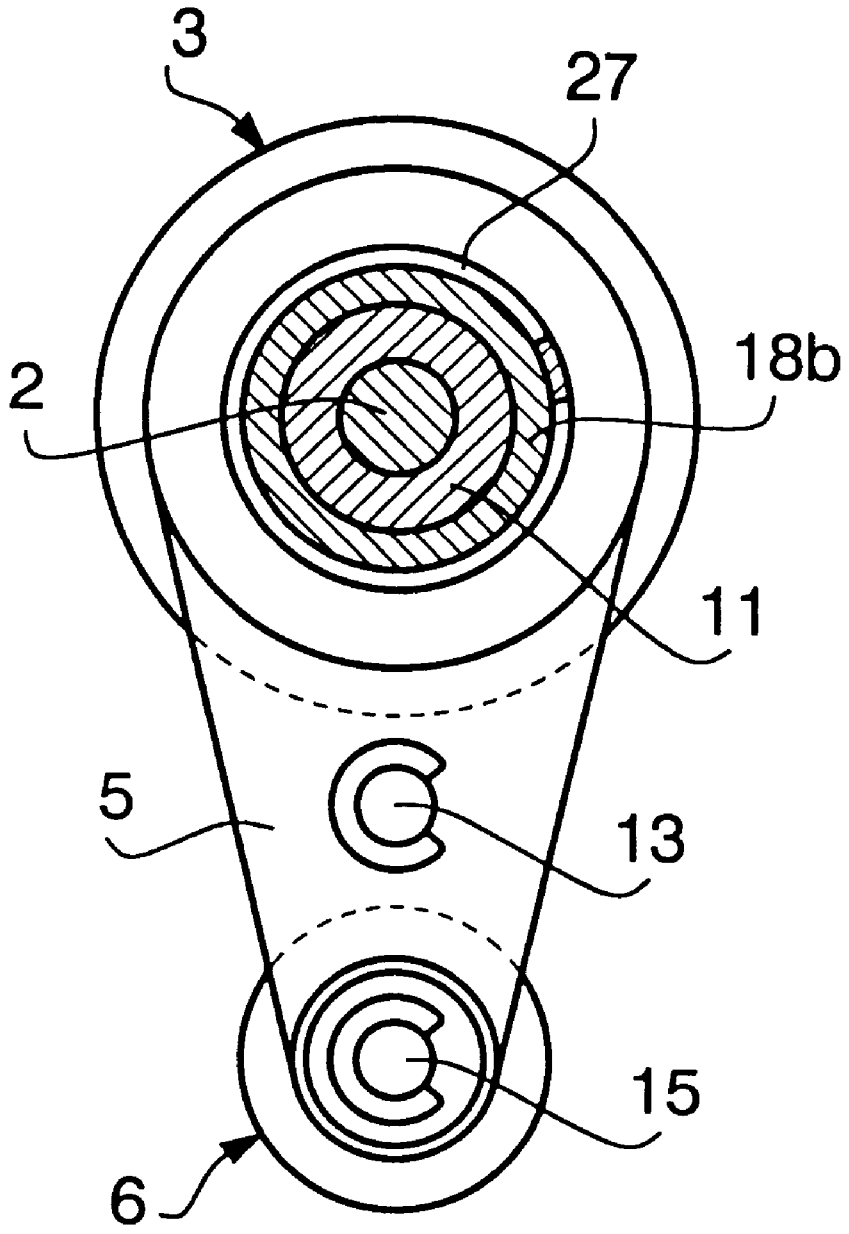
FIG. 2 illustrates a cross sectional view taken along the line A—A of FIG. 1.

Referring first to FIG. 1, a transmission mechanism 1 of this embodiment is incorporated in a sheet feeding roller device. The transmission mechanism 1 includes a drive shaft 2 extending in right and left directions of the drawing, a separate roller 3 rotatably supported on the drive shaft 2, left and right arms 4 and 5 pivotably supported by the drive shaft 2, a pick-up roller 6 supported between the right and left arms, a first clutch 7 for transmitting a drive power from the drive shaft 2 to the separate roller 3 or interrupting the drive power transmission, and an intermediate transmission device 8 for transmitting the drive power from the drive shaft 2 via the first clutch 7 to the pick-up roller 6. The intermediate transmission device 8 includes a second clutch 10 and a torque limiter 9. The drive shaft 2 is operatively connected to a drive power source such as a drive motor (not shown). In the illustrated embodiment, therefore, it can be said that the drive shaft 2 is a drive power source.

The separate roller 3 includes an inner cylinder 18 rotatably fitted over the drive shaft 2 via a cylinder 11 of the first clutch 7, and a main cylinder 19 press fitted over the inner cylinder 18. The main cylinder 19 is made of rubber or soft synthetic resin. The main cylinder 19 and inner cylinder 18 rotate together. The pick-up roller 6 includes an inner cylinder 17 rotatably fitted over a rotating shaft 15, and a main cylinder 20 press fitted over the inner cylinder 17. The main cylinder 20 is also made of rubber of soft synthetic resin, and rotates with the inner cylinder 17.

The first clutch 7 includes a stationary pin 25 fixed to the drive shaft 2, a drive cylinder 26 for receiving a drive power from the drive shaft 2 via the stationary pin 25, and a coil spring 27 for surrounding the right end of the cylinder 18, the right end of the cylinder 11 and the drive cylinder 26. The first clutch 7 is a one-way clutch which only allows drive power transmission from the drive cylinder 26 to the cylinders 18 and 11. The coil spring 27 determines drive power transmission and interruption. To this end, the coil spring 27 winds around (or twines around) the cylinders 18, 11 and 26 to stop relative slip between the coil spring and these cylinders with a particular force. The winding direction of the coil spring 27 and the twining force will be described later in detail.

Figure 3:
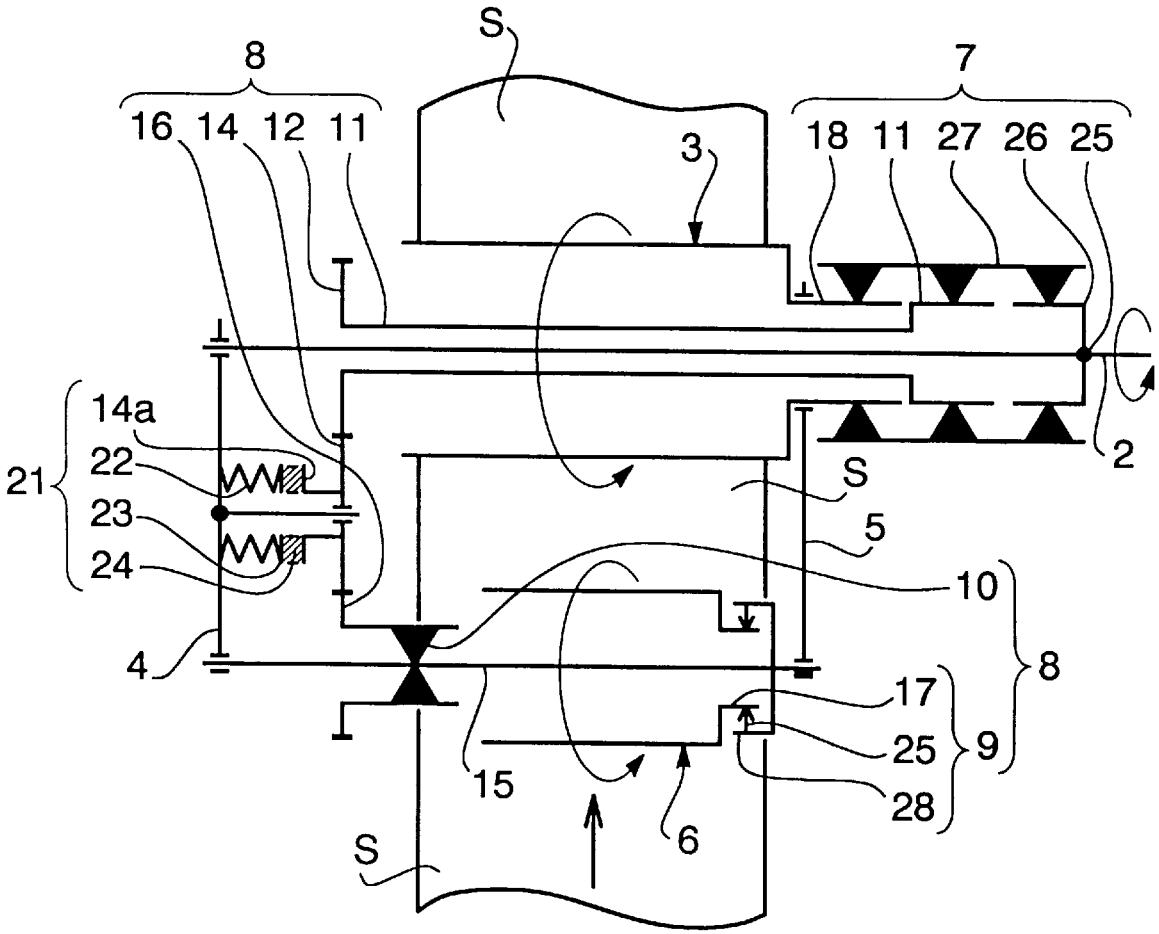
FIG. 3 schematically illustrates the sheet feeding roller device when it actually feeds the sheets.
Figure 4:
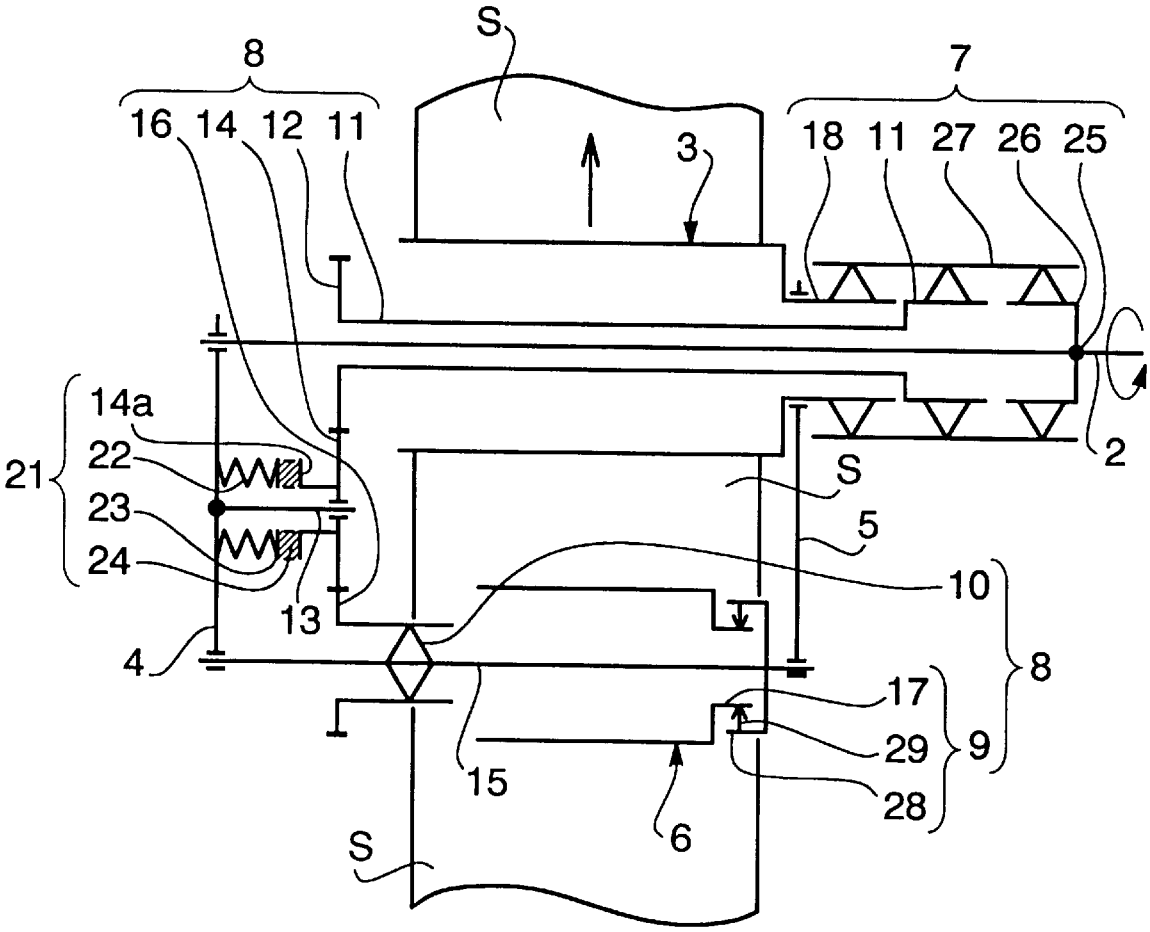
FIG. 4 schematically illustrates the sheet feeding roller device when it is in a sheet overfeeding condition.

Referring to FIG. 3, when the separate roller 3 and the pick-up roller 6 are driven, the coil spring 27 of the first clutch 7 tightly winds around the cylinders 18, 11 and 26 so that these cylinders are united (the shaded triangles indicate transmission of drive power). Referring to FIG. 4, on the other hand, when the separate roller 3 and the pick-up roller 6 rotate faster than a speed determined by the drive shaft 2, the coil spring 27 of the first clutch 7 becomes loose so that the coil spring 27 slips relative to the cylinders 18, 11 and 26. As a result, the drive power toward the drive shaft 2 from the separate roller 3 and pick-up roller 6 is interrupted (the unshaded triangles indicate interruption of drive power).

Referring back to FIG. 1, the cylinder 11 has an outer diameter slightly smaller than the cylinders 18 and 26 so that the coil spring 27 firmly or tightly holds the cylinders to transmit the drive power when it is twisted, and the coil spring reliably leases the cylinders when it is loosened to terminate the drive power transmission.

The inner cylinder 18 of the separate roller 3 has at its right end an enlarged diameter portion 18*a* to support the right arm 5, a reduced diameter portion 18*b* over which the coil spring 27 extends, and a stop 18*c* formed on the reduced diameter portion 18*b* to prevent the coil spring 27 from moving left beyond the stop 18*c*. Therefore, the right arm 5 can swing smoothly.

The intermediate transmission device 8 associated with the pick-up roller 6 includes the inner cylinder 11 rotatably fitted over the drive shaft 2, a first gear 12 mounted on the left end of the cylinder 11, a second gear 14 rotatably supported on a connection shaft 13 such that it meshes with the first gear 12, a third gear 16 supported on the rotating shaft 15 via the second clutch 10 such that it meshes with the second gear 14, the cylinder 17 rotatably fitted over the rotating shaft 15, and the torque limiter 9 located between the cylinder 17 of the pick-up cylinder 6 and the rotating shaft 15. The first gear 12 is removable from the inner cylinder 11. The connection shaft 13 is fixed to the left arm 4 at its left end, and detachably attached to the right arm 5 at its right end. The rotating shaft 15 is journally supported by the right and left arms 5 and 4 at its ends. The arms 4 and 5 swing together since the connection rod 13 and rotating shaft 15 unite them. Therefore, the pick-up roller 6 is able to swing while maintaining parallel relation to the drive shaft 2.

Between the second gear 14 and the left arm 4, provided is another torque limiter 21. This torque limiter 21 includes a pressure receiving plate 14*a* formed on the left end face of the second gear 14, a tubular member 23 having an end face opposed to the plate 14*a* and extending between the plate 14*a* and the left arm 4, a slip regulation plate 24 located between the plate 14*a* and the end face of the tubular member 23, and a coil spring 22 received in the tubular member 23 to bias the tubular member 23 toward the plate 14*a*. The slip regulation plate 24 is made of felt. If the torque limiter 21 prevents the second gear 14 from rotating and the drive power is transmitted to the second gear 14 from the drive shaft 2 via the first gear 12, the second gear 14 revolves around the first gear 12 to cause the arm 4 to swing. When the arm 4 stops a swing movement, the second gear 14 then causes the third gear 16 to rotate upon receiving a torque from the first gear 12 greater than a value (limit value) determined by the second torque limiter 21.

Referring to FIG. 3, the second clutch 10 located between the third gear 16 and the rotating shaft 15 transmits the drive power of the third gear 16 to the rotating shaft 15 in a normal condition (shaded triangles in the drawing indicate transmission of drive power). Referring to FIG. 4, however, the second clutch 10 interrupts the rotary power from the rotating shaft 15 to the third gear 16, which rotary power is generated due to overfeeding of the pick-up roller 6 (unshaded triangles indicate disconnection). Therefore, the second clutch 10 operates as a one-way clutch. The second clutch 10 causes the pick-up roller 6 to rotate faster than the rotating shaft 15 if the overfeeding by the sheet S occurs.

As illustrated in FIG. 1, the torque limiter 9 provided between the rotating shaft 15 and the cylinder 17 includes a drive cylinder 28 secured to the rotating shaft 15 and a coil spring 29 wound around the drive cylinder 28 and the right end of the cylinder 17. The coil spring 29 connects the drive cylinder 28 with the cylinder 17 with an appropriate tightening force to transmit the drive power. A certain unwinding force acts on the coil spring 29 when transmitting the drive power, but this unwinding force is sufficiently small not to affect the drive power transmission. The torque limiter 9 normally transmits the drive power from the drive cylinder 28 to the cylinder 17 via the coil spring 29. When the pick-up roller 6 stops upon contacting a stationary surface, the coil spring 29 of the torque limiter 9 is loosened so that the coil spring 29 no longer traps the cylinder 17 (or the spring 29 slips relative to the cylinder 17). Accordingly, the rotating shaft 15 rotates freely (lost motion). The lost motion of the rotating shaft 15 reduces the load exerted on the first to third gears 12, 14 and 16 of the transmission device 8.

Figure 6:
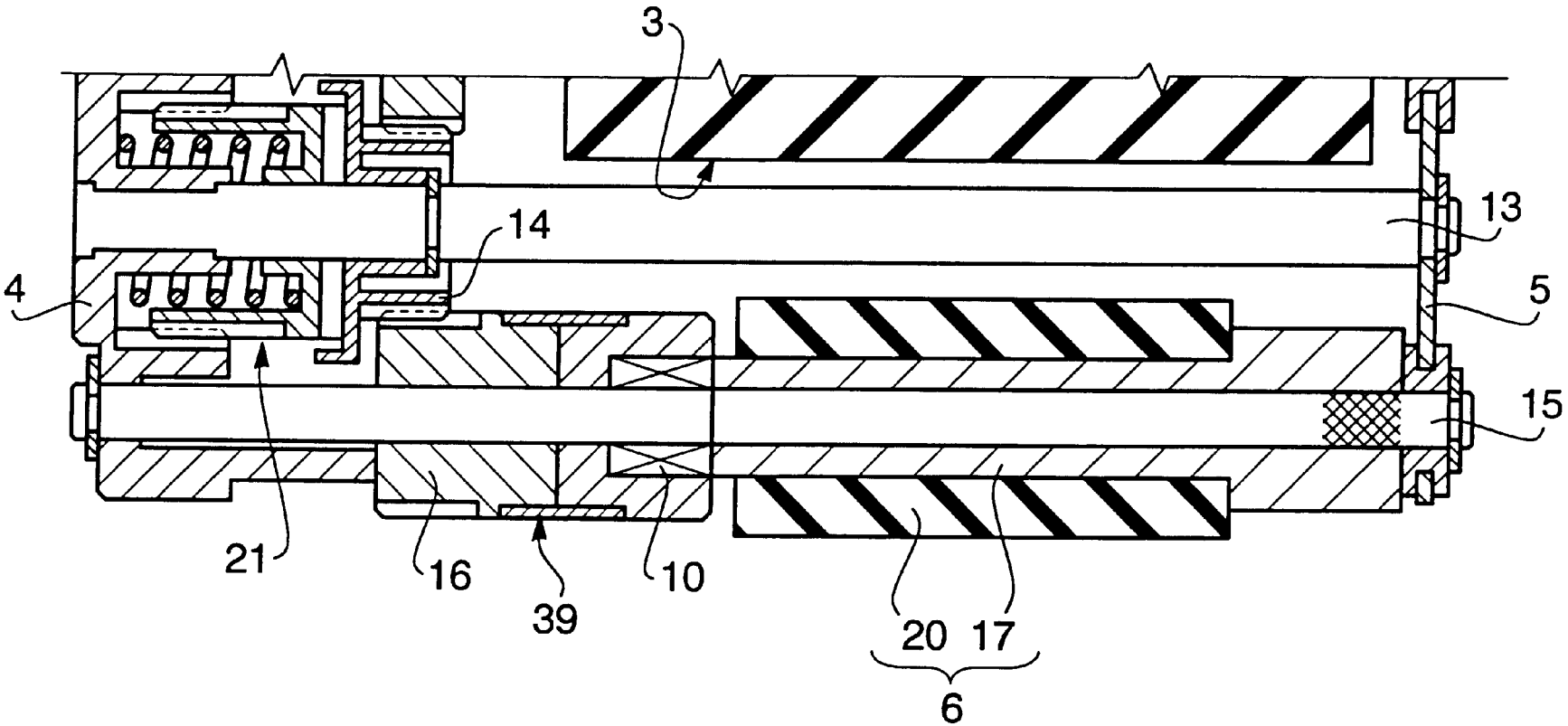
FIG. 6 illustrates a plan cross sectional view of a clutch and a torque limiter according to another embodiment.

Locations of the second clutch 10 and the torque limiter 9 are not limited to those illustrated in FIG. 1. For example, as shown in FIG. 6, a torque limiter 39 which is similar to the torque limiter 9 may be situated on the left side, and the second clutch 10 may be located next to the torque limiter 39. In this arrangement, the drive power is transmitted to the third gear 16, torque limiter 39, second clutch 10 and rotating shaft 15. The cylinder 17 fixed to the rotating shaft 15 is then rotated.

Figure 5:
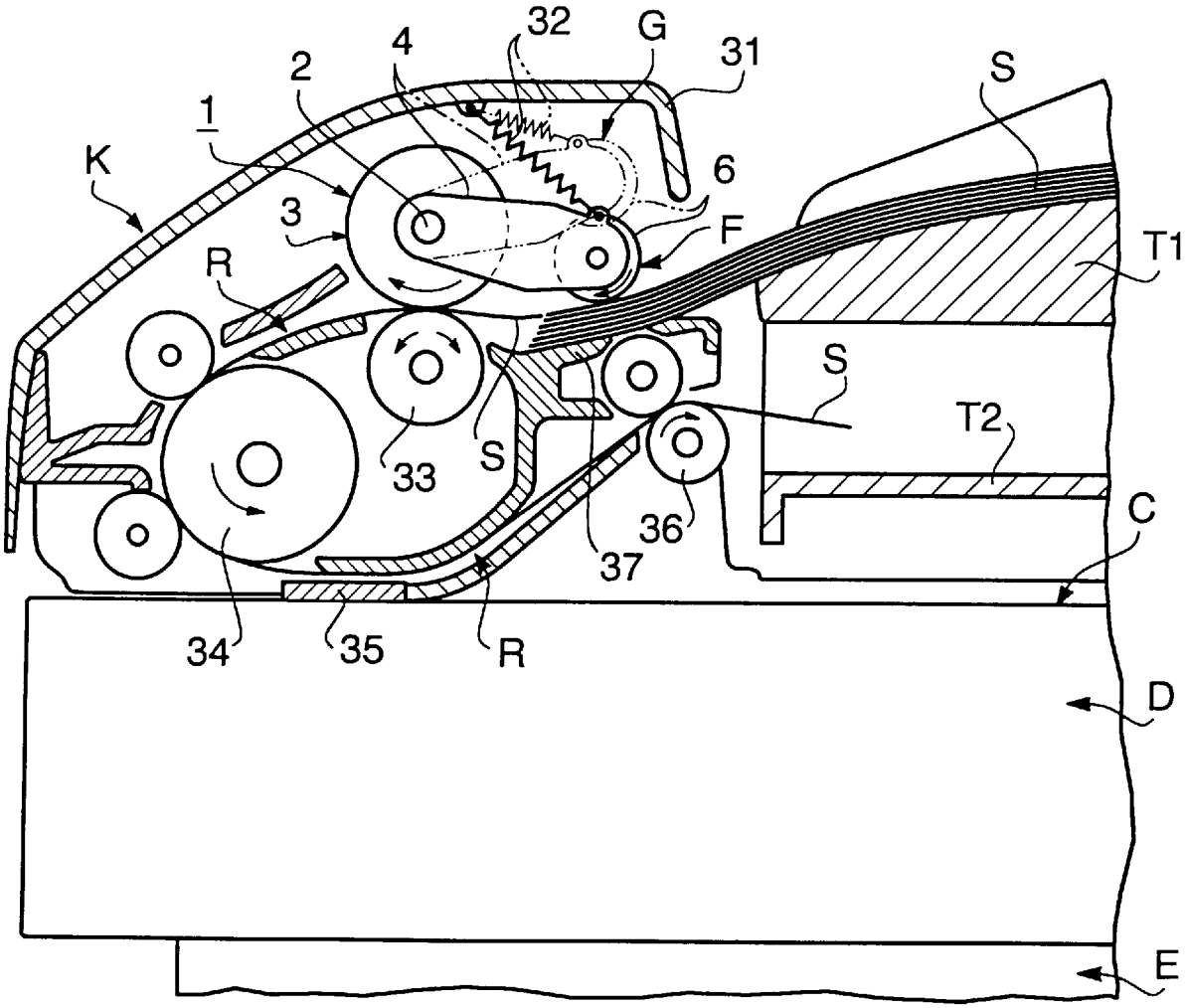
FIG. 5 is a lateral cross section of a document separate and feed device into which a transmission mechanism of the present invention is incorporated.

Referring now to FIG. 5, illustrated in cross section is a document separate and feed unit K for an image processing apparatus in which the transmission mechanism 1 of the invention is incorporated. The image processing apparatus has a stationary paper loading plate 37 and an inclined paper feed tray T1 continuous to the paper loading plate 37 in its upper area, and has a paper discharge tray T2 below the paper feed tray T1. The image processing apparatus also includes a stationary document loading surface C below the paper discharge tray T2 and a scanning unit D below the stationary document loading surface C. The scanning unit D has a scanner (not shown). Below the scanning unit D, the image processing apparatus further includes a recording sheet unit for transporting recording sheets and a recording unit. The recording sheet unit and recording unit are collectively represented by "E". The recording unit includes a printer which outputs data or image on a recording sheet based on information supplied from the scanner D or information sent from a remote facsimile machine or the like.

The document or a plurality of sheets S piled up on the paper feed tray T1 are separated one piece at a time and transported by the document separate and feed mechanism K toward the paper discharge tray T2. On the way to the paper discharge tray T2, information presented on the sheet S is scanned by the scanning unit D. A stationary document such as a book is placed on the stationary document loading surface C and scanned by the scanner D. The document separate and feed mechanism K has a sensor (not shown) for detecting presence of the sheets S on the paper feed tray T1.

The document separate and feed mechanism K forwards the sheets S in the following manner. (Operation 1) First, sheets S are stacked on the paper feed tray T1. The document separate and feed mechanism K detects presence of the sheets S on the tray T1 and activates a drive motor (not shown) to operate the transmission mechanism 1 and rotate a retard roller 33, a feed roller 34 and a discharge roller 36.

(Operation 2) As illustrated in FIG. 3, when the drive motor (not shown) is energized to rotate the drive shaft 2, rotations of the drive shaft 2 causes the coil spring 27 of the first clutch 7 to twine in a tightening direction so that the transmission mechanism 1 allows the drive power of the drive shaft 2 to be transferred to the separate roller 3 and intermediate transmission device 8 through the first clutch 7. In the intermediate transmission device 8, when the second gear 14 is prohibited from rotating by the torque limiter 21, the second gear 14 revolves around the first gear 12 upon rotations of the first gear 12. This causes the left arm 4 to swing forward toward the paper feed tray T1 together with the right arm 5. Referring to FIG. 5, as the arms 4 and 5 pivot forward, the pick-up roller 6 moves from a stand-by position G (two-dot chain line) to an operating position F (solid line) at which the pick-up roller 6 impinges upon the top sheet of the stack S. This movement of the pick-up roller 6 is a pivot movement against a spring force of a tension spring 32. After the pick-up roller 6 stops on the sheets S, a torque beyond the limit torque of the torque limiter 21 is transmitted to the second gear 14 from the first gear 12, and the drive power is transferred to the pick-up roller 6 through the third gear 16, second clutch (one-way clutch 10) and torque limiter 9. The pick-up roller 6 rotates to pick up one sheet S at a time from the top of the sheet stack toward the contact between the downstream separate roller 3 and retard roller 33.

(Operation 3) The rotating separate roller 3 and retard roller 33 sandwich the sheet(s) S and the separate roller 3 forwards the sheet into a sheet passageway R until the sheet reaches the feed roller 34. The feed roller 34 accelerates the sheet S and further forwards the sheet along the passageway R. If the separate roller 3 is still in contact with the rear end of the accelerated sheet S, the separate roller is pulled by the sheet S so that it is also accelerated. In this situation, the coil spring 27 of the one-way clutch 7 loosens so that the drive power from the drive shaft 2 is interrupted since the rotational speed of the fixed cylinder 26 is slower than that of the outer cylinder 18. As a result, the separate roller 3 and pick-up roller 6 rotate freely (lost motion) independent of the drive power from the drive shaft 2, and these roller rotate at the same speed (circumferential speed) as the accelerated sheet S. In addition, a force which imposes the right and left arms 5 and 4 to swing toward the paper feed tray Tl is no longer applied to the arms 4 and 5. Therefore, these arms are returned to the stand-by position G by the tension spring 32. It should be noted that even if the pick-up roller 6 is pulled (accelerated) by the accelerated sheet S before the first clutch 7 is brought into the disconnection condition, the second one-way clutch 10 interrupts the drive power from the drive shaft 2 so that the pick-up roller 6 rotates freely (lost motion).

(Operation 4) The accelerated sheet S is scanned while it is moving over a document scanning surface 35, and eventually discharged to the discharge tray T2 by the discharge roller 36. When the rear end of the sheet S leaves from the separate roller 3 and retard roller 33, no pulling force is applied to the separate roller 3 by the sheet S. Consequently, the transmission mechanism 1 is brought into the same operational condition as Operation 2 described above. The pick-up roller 6 is forced against the top sheet of the paper stack S again to feed one sheet at a time into the sheet passageway R. After that, Operation 3 is repeated.

(Operation 5) When the last sheet of the stack S is forwarded from the paper feed tray Tl to the paper discharge tray T2, the drive motor is deactivated. When the last sheet leaves from the separate roller 3, no pulling force is applied to the separate roller 3 by the sheet. Thus, the transmission mechanism 1 is brought into the condition of Operation 2. Before the drive motor is stopped, the pick-up roller 6 is pushed against the fixed sheet loading plate 37. However, the pick-up roller 6 in press-contact with the sheet loading plate 37 does not rotate since the drive power from the drive shaft 2 is interrupted by the torque limiter 9. Accordingly, no load is exerted on the intermediate transmission device 8. When the drive motor stops, the drive shaft 2 stops so that the coil spring 27 of the first one-way clutch 7 looses and the transmission mechanism 1 becomes an interruption condition. The force which imposes the right and left arms 5 and 4 to pivot toward the paper feed tray Tl does not act on the arms, and therefore the arms are returned to the stand-by position G by the tension spring 32. This condition continues until a next sheet is placed on the tray Tl.

The transmission mechanism for the pick-up roller is disclosed in Japanese Patent Application No. 9-242649 filed Sep. 8, 1997 and the entire disclosure thereof is incorporated herein by reference.

What is claimed is:

1. A transmission mechanism for a pick-up roller, adapted to acquire a drive power from a drive power source and to transmit the drive power to the pick-up roller thereby rotating the pick-up roller, comprising:

a torque limiter situated between the drive power source and the pick-up roller for transmitting the drive power to the pick-up roller from the drive power source in a normal condition but interrupting drive power transmission when an overload acts on the pick-up roller; and a clutch for preventing transmission of a drive power from the pick-up roller to the drive power source.

2. A transmission mechanism for a pick-up roller according to claim 1, wherein the torque limiter includes a coil spring wound around the pick-up roller that firmly winds around the pick-up roller in the normal condition thereby transmitting the drive power to the pick-up coil but unwinds and slips relative to the pick-up roller when an overload acts on the pick-up roller thereby interrupting drive power transmission from the drive power source to the pick-up roller.

3. A transmission mechanism for a pick-up roller according to claim 1, wherein the clutch prevents transmission of a drive power from the pick-up roller to the drive power source in an overfeeding condition.

4. A transmission mechanism for a pick-up roller according to claim 2, wherein the clutch prevents transmission of a drive power from the pick-up roller to the drive power source in an overfeeding condition.

5. A transmission mechanism for a pick-up roller according to claim 2, wherein a winding direction of the coil spring and intensity of the coil spring are determined such that a relatively small unwinding force that does not cause the coil spring to release the pick-up roller is applied to the coil spring in the normal condition thereby allowing the coil spring to transmit a drive power to the pick-up roller and a relatively large unwinding force that causes the coil spring to release the pick-up roller is applied to the coil spring in an overload condition.

6. A transmission mechanism for a pick-up roller according to claim 1, wherein the transmission mechanism is used for a document separate and feed device.

7. A transmission mechanism for a pick-up roller according to claim 2, wherein the transmission mechanism is used for a document separate and feed device.

8. A transmission mechanism for a pick-up roller according to claim 1, wherein the torque limiter and the clutch are both mounted on the pick-up roller.

9. A transmission mechanism for a pick-up roller according to claim 1, wherein the clutch is a one-way clutch that connects the drive power source with the pick-up roller in the normal condition but disconnects when the pick-up roller rotates faster than a predetermined speed.

10. A transmission mechanism for a pick-up roller according to claim 2, wherein the clutch is a one-way clutch that connects the drive power source with the pick-up roller in the normal condition but disconnects when the pick-up roller rotates faster than a predetermined speed.

11. A transmission mechanism for a pick-up roller according to claim 1, wherein the torque limiter interrupts drive power transmission when an unintentional break force acts on the pick-up roller.

12. A transmission mechanism for a pick-up roller according to claim 2, wherein the torque limiter interrupts drive power transmission when an unintentional break force acts on the pick-up roller.

13. A sheet feeding device comprising:

a drive power source;

a pick-up roller for picking up a sheet at a time from a stack of sheets piled on a paper feed tray;

a separate roller for forwarding a sheet, which is picked up by the pick-up roller, into a sheet passage;

a feed roller for transporting a sheet in the sheet passage;

a discharge roller for discharging a sheet onto a paper discharge tray from the sheet passage;

a first drive power transmission mechanism for connecting the drive power source to the separate roller to transmit the drive power to the separate roller from the drive power source when the separate roller rotates not faster than a predetermined speed and for disconnecting the separate roller from the drive power source when the separate roller rotates faster than the predetermined speed; and a second drive power transmission mechanism for normally connecting the separate roller to the pick-up roller to transmit a drive power to the pick-up roller from the drive power source via the separate roller but disconnecting the pick-up roller from the separate roller when the pick-up roller contacts an empty paper feed tray.

14. A sheet feeding device of claim 13, wherein the first drive power transmission mechanism includes a spring wound around the separate roller.

15. A sheet feeding device of claim 13, wherein the second drive power transmission mechanism includes a spring wound around the pick-up roller.

16. A sheet feeding device of claim 13 further including a third drive power transmission mechanism for disconnecting the pick-up roller from the drive power source when the pick-up roller rotates faster than a predetermined speed.

17. A sheet feeding device of claim 13, wherein the second transmission mechanism is a torque limiter mounted on the pick-up roller.

18. A sheet feeding device of claim 16, wherein the third transmission mechanism is a one-way clutch mounted on the pick-up roller.

* * * * *